US010340129B2

(12) United States Patent
Nagata et al.

(10) Patent No.: US 10,340,129 B2
(45) Date of Patent: Jul. 2, 2019

(54) MICROCHANNEL PLATE AND ELECTRON MULTIPLIER

(71) Applicant: HAMAMATSU PHOTONICS K.K., Hamamatsu-shi, Shizuoka (JP)

(72) Inventors: Takaaki Nagata, Hamamatsu (JP); Yasumasa Hamana, Hamamatsu (JP); Hajime Nishimura, Hamamatsu (JP); Kimitsugu Nakamura, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 15/756,217

(22) PCT Filed: Aug. 9, 2016

(86) PCT No.: PCT/JP2016/073490
§ 371 (c)(1),
(2) Date: Feb. 28, 2018

(87) PCT Pub. No.: WO2017/038410
PCT Pub. Date: Mar. 9, 2017

(65) Prior Publication Data

US 2018/0247802 A1 Aug. 30, 2018

(30) Foreign Application Priority Data

Sep. 4, 2015 (JP) ..... 2015-174632

(51) Int. Cl.
*H01J 43/24* (2006.01)
*H01J 9/12* (2006.01)

(52) U.S. Cl.
CPC ..... *H01J 43/246* (2013.01); *H01J 9/12* (2013.01); *H01J 9/125* (2013.01); *H01J 43/24* (2013.01); *H01J 2201/32* (2013.01)

(58) Field of Classification Search
CPC .. H01J 43/246; H01J 9/125; H01J 9/12; H01J 43/24; H01J 2201/32
See application file for complete search history.

(56) References Cited

U.S. PATENT DOCUMENTS 4,780,395 A * 10/1988 Saito ..... C03C 17/10 313/103 CM
5,378,960 A * 1/1995 Tasker ..... H01J 9/12 313/103 CM (Continued)

FOREIGN PATENT DOCUMENTS

CN 202384295 U 8/2012
JP H06-60800 A 3/1994

(Continued)

OTHER PUBLICATIONS

International Preliminary Report on Patentability dated Mar. 15, 2018 for PCT/JP2016/073490.

(Continued)

*Primary Examiner* — Kevin Quarterman
(74) *Attorney, Agent, or Firm* — Drinker Biddle & Reath LLP

(57) ABSTRACT

A microchannel plate is provided with a substrate including a front surface, a rear surface, and a side surface, a plurality of channels penetrating from the front surface to the rear surface of the substrate, a first film provided on at least an inner wall surface of the channel, a second film provided on the first film, and electrode layers provided on the front surface and the rear surface of the substrate. The first film is made of $Al_2O_3$. The second film is made of $SiO_2$. The first film is thicker than the second film.

20 Claims, 8 Drawing Sheets

(56) References Cited

U.S. PATENT DOCUMENTS

| | | | | |
|---|---|---|---|---|
| 5,569,355 | A | 10/1996 | Then et al. | |
| 6,870,308 | B2 * | 3/2005 | Heo | B82Y 10/00 313/103 R |
| 8,507,872 | B2 * | 8/2013 | Feller | G01T 3/00 250/370.05 |
| 9,064,676 | B2 * | 6/2015 | Sullivan | H01J 43/04 |
| 9,257,266 | B2 * | 2/2016 | Nakamura | H01J 43/246 |
| 9,941,438 | B2 * | 4/2018 | Feller | G01T 3/08 |
| 2009/0212680 | A1 * | 8/2009 | Tremsin | H01J 43/246 313/103 R |
| 2013/0240907 | A1 | 9/2013 | Nutzel et al. | |
| 2014/0028175 | A1 | 1/2014 | Sullivan et al. | |

FOREIGN PATENT DOCUMENTS

| | | | |
|---|---|---|---|
| JP | 2011-513921 | A | 4/2011 |
| JP | 2011-525246 | A | 9/2011 |
| WO | WO-2009/148643 | A2 | 12/2009 |
| WO | WO-2014/050260 | A1 | 4/2014 |

OTHER PUBLICATIONS

Jokela, Slade J. et al., "Secondary electron yield of emissive materials for large-area micro-channel plate detectors: surface composition and film thickness dependencies," SciVerse ScienceDirect Physics Procedia, 37 (2012), pp. 740-747.

* cited by examiner

MICROCHANNEL PLATE AND ELECTRON MULTIPLIER

TECHNICAL FIELD

One aspect of the present invention relates to a microchannel plate and an electron multiplier.

BACKGROUND ART

Conventionally, a microchannel plate provided with a substrate including a front surface and a rear surface and a plurality of channels penetrating from the front surface to the rear surface of the substrate is known (refer to, for example, Patent Document 1). In this microchannel plate, a first emission layer is formed in the channel and a second emission layer is formed on the first emission layer.

CITATION LIST

Patent Literature

Patent Document 1: Japanese Unexamined Patent Application Publication No. 2011-513921

SUMMARY OF INVENTION

Technical Problem

Generally, a microchannel plate is a device used in a vacuum tube such as an image intensifier or a photomultiplier tube. When handleability during manufacturing and a transport environment to customers of the microchannel plate alone are taken into consideration, stability of a characteristic under an environment different from that of the vacuum tube is important. In the conventional technology described above, for example, in a case where the microchannel plate is exposed to the atmosphere, a surface of a second emission layer formed of an $Al_2O_3$ layer is contaminated or altered, and as a result, a gain might be deteriorated over time. In the above-described conventional technology, since magnitude of a secondary electron emission coefficient of the first emission layer and a secondary electron emission coefficient of the second emission layer are not sufficiently taken into consideration in a configuration of the microchannel plate, for example, even if the secondary electron emission coefficient of the first emission layer is large, it is not possible to utilize a characteristic thereof and thus the gain of the microchannel plate might be lowered.

An object of one aspect of the present invention is to provide a microchannel plate and an electron multiplier capable of suppressing deterioration over time of the gain while improving the gain.

Solution to Problem

In order to solve the above-described problem, the inventors of the present invention exhaustively study. As a result, the inventors of the present invention have found that the deterioration over time of the gain may be suppressed by providing a first film made of $Al_2O_3$ (aluminum oxide) on an inner wall surface of a channel and providing a second film made of $SiO_2$ (silicon dioxide) on the first film. In addition, the inventors of the present invention have found that it is possible to utilize the characteristic of $Al_2O_3$ having a large secondary electron emission coefficient to efficiently improve the gain by making the first film made of $Al_2O_3$ thicker than the second film made of $SiO_2$ to achieve the present invention.

A microchannel plate according to one aspect of the present invention is provided with a substrate including a front surface, a rear surface, and a side surface, a plurality of channels penetrating from the front surface to the rear surface of the substrate, a first film provided on at least an inner wall surface of the channel, a second film provided on the first film, and electrode layers provided on the front surface and the rear surface of the substrate, in which the first film is made of $Al_2O_3$, the second film is made of $SiO_2$, and the first film is thicker than the second film.

In the microchannel plate, since the second film made of $SiO_2$ is provided on the first film made of $Al_2O_3$, it is possible to suppress deterioration over time of the gain when the microchannel plate is exposed to the atmosphere, for example. Since the first film made of $Al_2O_3$ is thicker than the second film made of $SiO_2$, it is possible to allow the first film made of $Al_2O_3$ to serve as a main secondary electron multiplier layer while utilizing the characteristic of $Al_2O_3$ having a large secondary electron emission coefficient, thereby efficiently improving the gain. Therefore, it is possible to suppress the deterioration over time of the gain while improving the gain.

In the microchannel plate according to one aspect of the present invention, a thickness of the first film may be 10 angstroms (Å) or more when being calculated using X-ray fluorescence analysis. If the first film made of $Al_2O_3$ has a thickness of 10 angstroms or more in this manner, the first film may be allowed to effectively serve as the secondary electron multiplier layer.

In the microchannel plate according to one aspect of the present invention, the substrate may be made of an insulating material, and a resistance film may be formed between the inner wall surface of the channel and the first film In this case, when voltage is applied between the electrode layer provided on the front surface of the substrate and the electrode layer provided on the rear surface of the substrate, a potential gradient is formed by the resistance film, and electron multiplication becomes possible.

In the microchannel plate according to one aspect of the present invention, the substrate may be made of a resistant material. In this case, it is unnecessary to provide the resistance film on the inner wall surface of the channel, and a manufacturing process of the resistance film may be omitted, so that a manufacturing cost may be reduced.

In the microchannel plate according to one aspect of the present invention, the first film and the second film are formed on the front surface, the rear surface, and the side surface of the substrate, and the electrode layer may be formed on the second film. Alternatively, the electrode layers may be formed so as to be in contact with the front surface and the rear surface of the substrate, and the first film and the second film may be formed on the electrode layers, and the front surface, the rear surface, and the side surface of the substrate. In these configurations, since the first film and the second film cover the front surface, the rear surface, and the side surface of the substrate, in a case where the substrate is made of a material which emits a large amount of gas, for example, gas emission from the substrate may be effectively suppressed.

In the microchannel plate according to one aspect of the present invention, the resistance film, the first film, and the second film may be formed on the front surface, the rear surface, and the side surface of the substrate, and the electrode layers may be formed on the second film. Alternatively, the electrode layers may be formed so as to be in contact with the front surface and the rear surface of the substrate, and the resistance film, the first film, and the second film may be formed on the front surface, the rear surface, and the side surface of the substrate. In these configurations, since not only the first film and the second film but also the resistance film cover the front surface, the rear surface, and the side surface of the substrate, the gas emission from the substrate may be effectively suppressed in the case where the substrate is made of the material which emits a large amount of gas, for example.

In the microchannel plate according to one aspect of the present invention, the first film and the second film may be layers formed by atomic layer deposition. In this case, since the first film and the second film may be formed at an atomic layer level, a film in which a defect such as a pinhole is suppressed with a uniform film quality may be formed.

An electron multiplier according to one aspect of the present invention is provided with a main body including a front surface, a rear surface, and a side surface, a channel penetrating from the front surface to the rear surface of the main body, a first film provided on at least an inner wall surface of the channel, a second film provided on the first film, and electrode layers provided on the front surface and the rear surface of the main body, in which the first film is made of $Al_2O_3$, the second film is made of $SiO_2$, and the first film is thicker than the second film.

In the electron multiplier, since the second film made of $SiO_2$ is provided on the first film made of $Al_2O_3$, it is possible to suppress the deterioration over time of the gain when the electron multiplier is exposed to the atmosphere, for example. Since the first film made of $Al_2O_3$ is thicker than the second film made of $SiO_2$, it is possible to allow the first film made of $Al_2O_3$ to serve as a main secondary electron multiplier layer while utilizing the characteristic of $Al_2O_3$ having a large secondary electron emission coefficient, thereby efficiently improving the gain. Therefore, it is possible to suppress the deterioration over time of the gain while improving the gain.

In the electron multiplier according to one aspect of the present invention, a thickness of the first film may be 10 angstroms or more when being calculated using X-ray fluorescence analysis. When the first film has the thickness of 10 angstroms or more in this manner, the first film made of $Al_2O_3$ may be allowed to effectively serve as the secondary electron multiplier layer.

In the electron multiplier according to one aspect of the present invention, the main body may be made of an insulating material, and a resistance film may be foamed between the inner wall surface of the channel and the first film. In this case, when voltage is applied between the electrode layer provided on the front surface of the main body and the electrode layer provided on the rear surface of the main body, a potential gradient is formed by the resistance film, and electron multiplication becomes possible.

In the electron multiplier according to one aspect of the present invention, the main body may be made of a resistant material. In this case, it is unnecessary to provide the resistance film on the inner wall surface of the channel, and a manufacturing process of the resistance film may be omitted, so that a manufacturing cost may be reduced.

In the electron multiplier according to one aspect of the present invention, the first film and the second film may be formed on the front surface, the rear surface, and the side surface of the main body, and the electrode layers may be formed on the second film. Alternatively, the electrode layers may be formed so as to be in contact with the front surface and the rear surface of the main body, and the first film and the second film may be formed on the electrode layers, and the front surface, the rear surface, and the side surface of the main body. In these configurations, since the first film and the second film cover the front surface, the rear surface, and the side surface of the main body, in a case where the main body is made of a material which emits a large amount of gas, for example, gas emission from the main body may be effectively suppressed.

In the electron multiplier according to one aspect of the present invention, the resistance film, the first film, and the second film may be formed on the front surface, the rear surface, and the side surface of the main body, and the electrode layers may be formed on the second film. Alternatively, the electrode layers may be formed so as to be in contact with the front surface and the rear surface of the main body, and the resistance film, the first film, and the second film may be formed on the front surface, the rear surface, and the side surface of the main body. In these configurations, since not only the first film and the second film but also the resistance film cover the front surface, the rear surface, and the side surface of the main body, the gas emission from the main body may be effectively suppressed in the case where the main body is made of the material which emits a large amount of gas, for example.

In the electron multiplier according to one aspect of the present invention, the first film and the second film may be layers formed by atomic layer deposition. In this case, since the first film and the second film may be formed at an atomic layer level, a film in which a defect such as a pinhole is suppressed with a uniform film quality may be formed.

Effects of Invention

According to one aspect of the present invention, it is possible to provide a microchannel plate and an electron multiplier capable of suppressing deterioration over time of a gain while improving the gain.

DESCRIPTION OF EMBODIMENTS

Hereinafter, embodiments according to one aspect of the present invention are described in detail with reference to the accompanying drawings. In the description of the drawings, the same reference sign is assigned to the same or corresponding elements and the description is not repeated.

[First Embodiment]

Figure 1A:
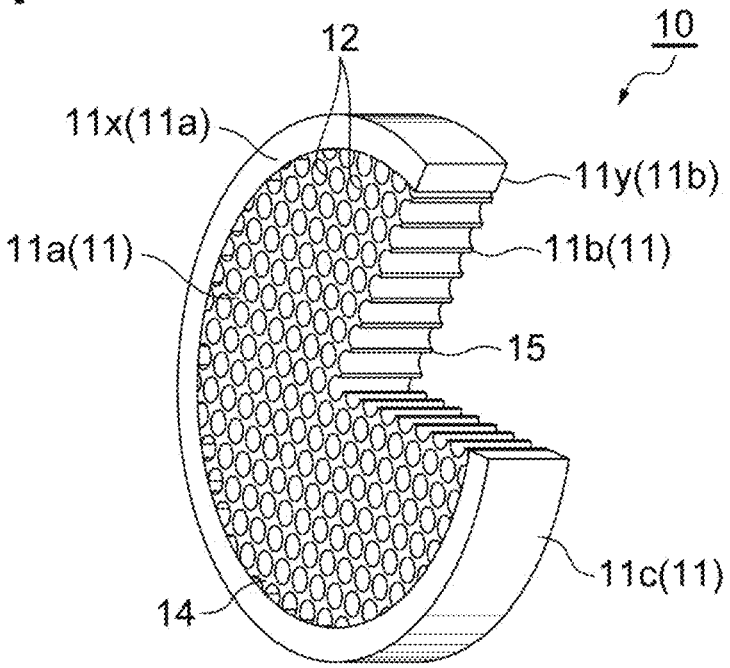
FIG. 1A is a perspective view of a microchannel plate according to a first embodiment.

FIG. 1A is a perspective view of a microchannel plate according to a first embodiment. FIG. 1 illustrates the microchannel plate with a cross-section of a part thereof. As illustrated in FIG. 1A, a microchannel plate 10 is a member having a function of multiplying electrons. The microchannel plate 10 includes a disc-shaped substrate 11 including an input surface (front surface) 11*a* and an output surface (rear surface) 11*b*. The substrate 11 is made of an insulating material such as soda-lime glass, borosilicate glass, lead glass, or an aluminum oxide treated with alumite treatment, for example. A plurality of channels 12 having a circular cross-section is formed in the substrate 11. The channel 12 penetrates from the input surface 11*a* to the output surface 11*b* of the substrate 11. The channels 12 are arranged in a matrix pattern in a plan view such that a center-to-center distance between adjacent channels 12 is, for example, several micrometers to tens of micrometers. A length of the channel 12 in a thickness direction of the microchannel plate 10 is, for example, 430 μm. A diameter of the channel 12 is, for example, 10 μm.

Figure 1B:
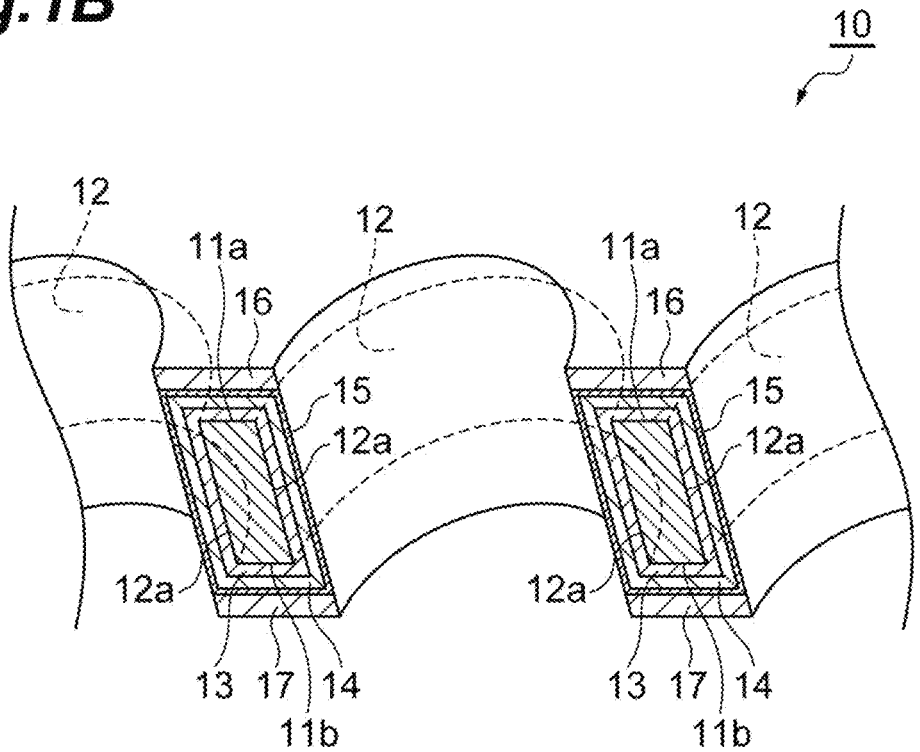
FIG. 1B is a perspective view illustrating a film configuration of the microchannel plate of FIG. 1A.

FIG. 1B is a perspective view illustrating a film configuration of the microchannel plate of FIG. 1A. FIG. 1B illustrates a film configuration of a cross-section along the thickness direction in the microchannel plate 10. As illustrated in FIG. 1B, a resistance film 13, an electron emission film (first film) 14, a protection film (second film) 15, an input electrode (electrode layer) 16, and an output electrode (electrode layer) 17 are formed on the substrate 11, as functional films.

The resistance film 13 is provided on an inner wall surface 12*a* of the channel 12. The resistance film 13 is provided so as to cover an outer surface of the substrate 11. Specifically, the resistance film 13 is formed on at least the inner wall surface 12*a* of the channel 12. The resistance film 13 is formed on the input surface 11*a* including an edge 11*x* where the channel 12 is not formed. The resistance film 13 is formed on the output surface 11*b* including an edge 11*y* where the channel 12 is not formed. The edges 11*x* and 11*y* are provided, for example, for the convenience of handling of the microchannel plate 10.

In the cross-section illustrated in FIG. 1B, the resistance film 13 is formed into a rectangular frame shape surrounding the substrate 11. The resistance film 13 is formed so as to cover a side surface 11*c* of the substrate 11. The resistance film 13 covers the input surface 11*a*, the output surface 11*b*, the inner wall surface 12*a* of the channel 12, and the side surface 11*c* in the above-described manner, so that gas emission from the substrate 11 may be effectively suppressed in a case where the substrate 11 is made of the material such as lead glass which emits a large amount of gas during operation, for example. The resistance film has a predetermined resistance value suitable for electron multiplication in the microchannel plate 10.

The resistance film 13 is formed by using, for example, the atomic layer deposition (ALD). The resistance film 13 is formed, for example, by repeating a cycle of depositing an $Al_2O_3$ layer and a cycle of depositing a $TiO_2$ layer by the atomic layer deposition a plurality of times respectively. A thickness of the resistance film 13 is, for example, approximately 200 angstroms to 700 angstroms.

The atomic layer deposition is a method of repeatedly performing an adsorption process of a molecule of a compound, a film formation process by reaction, and a purge process of removing a surplus molecule, thereby depositing (stacking) atomic layers one by one to obtain a thin film. As a material for forming the electron emission film 14 and the protection film 15, a metal oxide is used from the viewpoint of obtaining chemical stability. Examples of such metal oxide include $Al_2O_3$, MgO, BeO, CaO, SrO, BaO, $SiO_2$, $TiO_2$, RuO, ZrO, NiO, CuO, GaO, ZnO and the like, for example. By using the atomic layer deposition, since the film is formed at an atomic layer level, a film in which a defect such as a pinhole is suppressed with a uniform film quality may be formed. A mixed film containing a plurality of metal oxides may be formed in the order of angstroms. For example, it is possible to formed a film for a gap and a trench structure with a high aspect ratio.

The electron emission film 14 is the first film provided on the inner wall surface 12*a* of the channel 12. The electron emission film 14 is provided so as to cover the resistance film 13. Specifically, the electron emission film 14 is formed so as to be in contact with the resistance film 13 on at least the inner wall surface 12*a* of the channel 12. The electron emission film 14 is formed so as to be in contact with the resistance film 13 on the input surface 11*a* including the edge 11*x* where the channel 12 is not formed. The electron emission film 14 is formed so as to be in contact with the resistance film 13 on the output surface 11*b* including the edge 11*y* where the channel 12 is not formed. The electron emission film 14 is formed into a rectangular frame shape so as to surround the resistance film 13 in the cross-section illustrated in FIG. 1B. The electron emission film 14 is formed so as to cover the side surface 11*c* of the substrate 11. The electron emission film 14 covers the input surface 11*a*, the output surface 11*b*, the inner wall surface 12*a* of the channel 12, and the side surface 11*c* in the above-described manner, so that the gas emission from the substrate 11 may be effectively suppressed in the case where the substrate 11 is made of the material such as lead glass which emits a large amount of gas during operation, for example. When electrons accelerated by an electric field (to be described later) in the channel 12 collide with the electron emission film 14, the electron emission film 14 emits secondary electrons accordingly and multiplies the electrons.

The electron emission film 14 is made of $Al_2O_3$. The electron emission film 14 is formed by using the atomic layer deposition, for example. The electron emission film 14 is formed, for example, by repeating a cycle of depositing an $Al_2O_3$ layer by the atomic layer deposition a plurality of times. In a case of forming the electron emission film 14, trimethylaluminum may be used, for example, as reaction gas. In this case, a process of forming the electron emission film 14 includes an $H_2O$ adsorption process, an $H_2O$ purge process, a trimethylaluminum adsorption process, and a trimethylaluminum purge process. In the process of forming the electron emission film 14, a series of processes is repeatedly performed until a desired thickness of the electron emission film 14 is realized.

The electron emission film 14 has the thickness of 10 angstroms or more. The "thickness of the film" is herein intended to mean a value corresponding to a film thickness calculated on the basis of a signal value regarding presence of an element contained in the film obtained by analyzing the film using the X-ray fluorescence analysis (XRF) (thickness calculated using X-ray fluorescence analysis). That is, the thickness of the electron emission film 14 is 10 angstroms or more in a case where the thickness of the electron emission film 14 is calculated using the X-ray fluorescence analysis.

More preferably, the thickness of the electron emission film 14 is, for example, approximately 30 angstroms to 50 angstroms.

The protection film 15 is the second film provided on the electron emission film 14 (first film). The protection film 15 is provided so as to cover the electron emission film 14. Specifically, the protection film 15 is formed so as to be in contact with the electron emission film 14 at least on the inner wall surface 12*a* of the channel 12. The protection film 15 is formed so as to be in contact with the electron emission film 14 on the input surface 11*a*. The protection film 15 is formed so as to be in contact with the electron emission film 14 on the output surface 11*b*. The protection film 15 is formed into a rectangular frame shape so as to surround the electron emission film 14 in the cross-section illustrated in FIG. 1B. The protection film 15 is formed so as to cover the side surface 11*c* of the substrate 11. The protection film 15 suppresses deterioration over time of a gain (gain) of secondary electron emission in the microchannel plate 10 (to be described later in detail).

The protection film 15 is made of $SiO_2$. The protection film 15 is formed by using the atomic layer deposition, for example. The protection film 15 is formed, for example, by repeating a cycle of depositing a $SiO_2$ layer by the atomic layer deposition a plurality of times. A thickness of the protection film 15 is, for example, a half or less of that of the electron emission film 14. More preferably, the thickness of the protection film 15 is, for example, approximately 3 angstroms to 15 angstroms. That is, the electron emission film 14 is thicker than the protection film 15.

Figure 3:
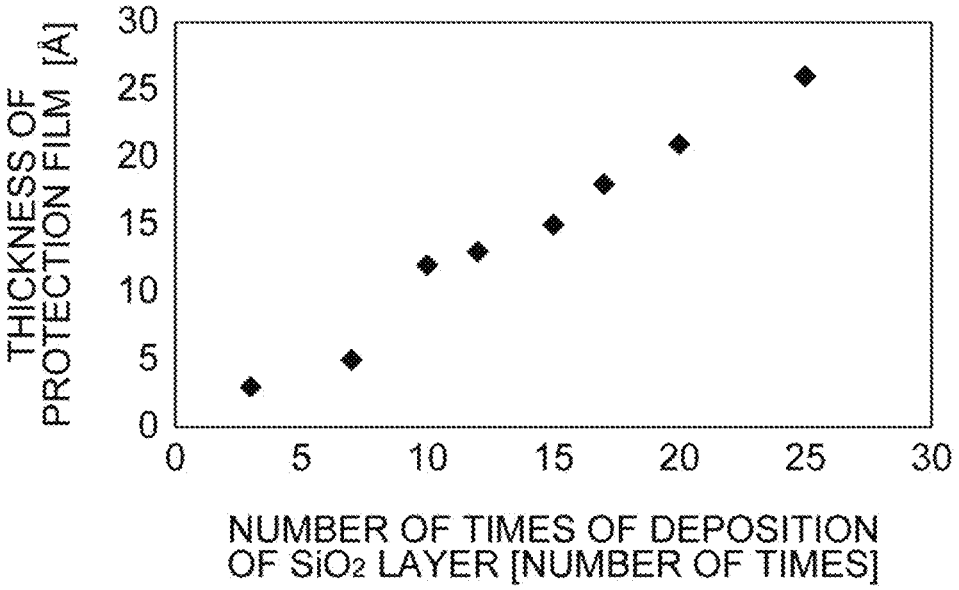
FIG. 3 is a view illustrating a relationship between the number of times of deposition of a $SiO_2$ layer and a thickness of a protection film.

As illustrated in FIG. 3, in a case of using the atomic layer deposition, as the number of times of deposition of the $SiO_2$ layer at the time of forming a $SiO_2$ film increases, the thickness of the $SiO_2$ film (thickness calculated by using the X-ray fluorescence analysis) increases. Herein, as the number of times of deposition of the $SiO_2$ layer increases by one, the thickness of the $SiO_2$ film increases by approximately 1 angstrom. That is, one deposition of the $SiO_2$ layer (one cycle) corresponds to the thickness of the $SiO_2$ film of 1 angstrom. In this manner, it is possible to make the thickness of the $SiO_2$ film a desired thickness by changing the number of times of deposition of the $SiO_2$ layer.

The input electrode 16 and the output electrode 17 are provided on the input surface 11*a* and the output surface 11*b* of the substrate 11, respectively. Specifically, the input electrode 16 is formed so as to be in contact with the protection film 15 on the input surface 11*a* other than the edge. The output electrode 17 is formed so as to be in contact with the protection film 15 on the output surface 11*b* other than the edge. The input electrode 16 and the output electrode 17 are formed by evaporating an ITO film made of, for example, $In_2O_3$ and $SnO_2$, a nesa ($SnO_2$) film, a nichrome film, an Inconel (registered trademark) film or the like. By using evaporation, the input electrode 16 is formed on the input surface 11*a* except for an opening of the channel 12, and the output electrode 17 is formed on the output surface 11*b* except for the opening of the channel 12. Thicknesses of the input electrode 16 and the output electrode 17 are, for example, approximately 1000 angstroms. Voltage potential which is higher in the output electrode 17 than in the input electrode 16 is applied to the input electrode 16 and the output electrode 17 such that an electric field directed from the input electrode 16 to the output electrode 17 is generated in the channel 12.

Herein, in order to specify structures or characteristics of the resistance film 13, the electron emission film 14, and the protection film 15 (hereinafter referred to as "ALD film" in this paragraph) formed by the atomic layer deposition, a surface state of the ALD film is necessarily analyzed. However, regarding the ALD film formed on a structure with a high aspect ratio such as the microchannel plate 10, no device capable of specifically analyzing the surface state thereof is currently known. It is difficult to analyze a laminated structure itself of the ALD film. As described above, it is technically impossible or impractical to analyze the structure or the characteristic of the ALD film at the time of filing, so that there is a circumstance that it is impossible or impractical to directly specify the ALD film by its structure or characteristic in the microchannel plate 10.

Next, a method of manufacturing the microchannel plate 10 is described.

Figure 2:
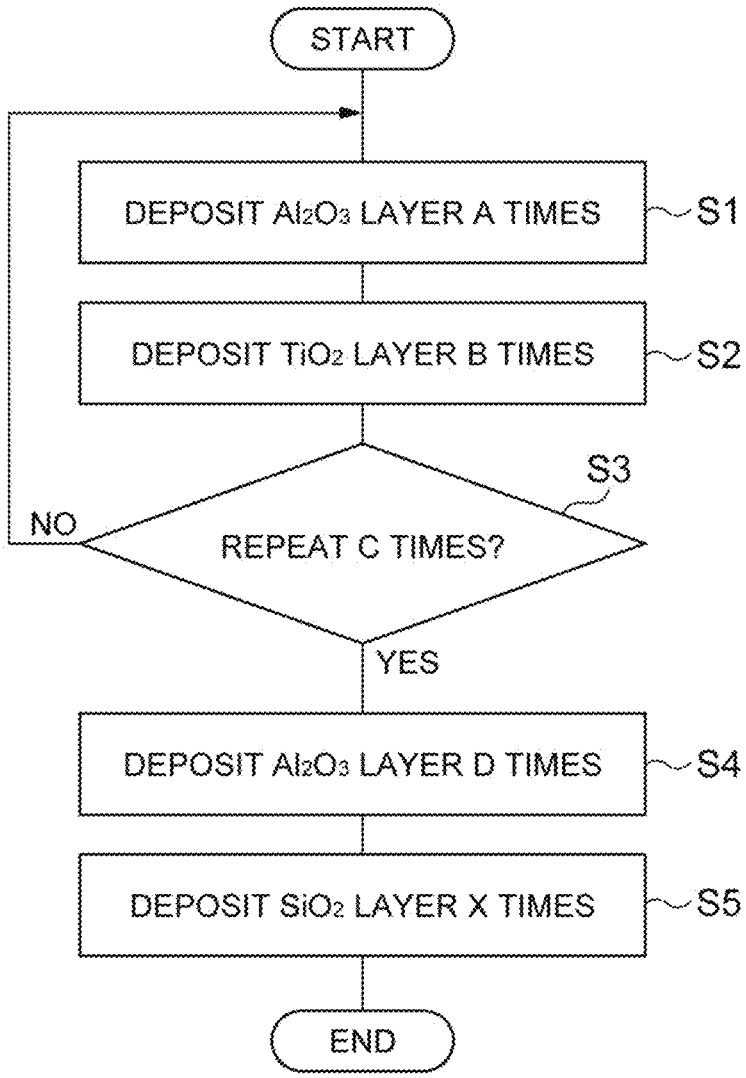
FIG. 2 is a flowchart illustrating a film forming process of the microchannel plate of FIG. 1.

FIG. 2 is a flowchart illustrating a film forming process of the microchannel plate of FIG. 1A. First, the resistance film 13 is formed on the substrate 11 at steps S1 to S3. Specifically, as illustrated in FIG. 2, a cycle of depositing the $Al_2O_3$ layer using the atomic layer deposition is repeated A times (step S1). Subsequently, a cycle of depositing the $TiO_2$ layer is repeated B times (step S2). Steps S1 and S2 are repeated C times (step S3).

Figure 8A:
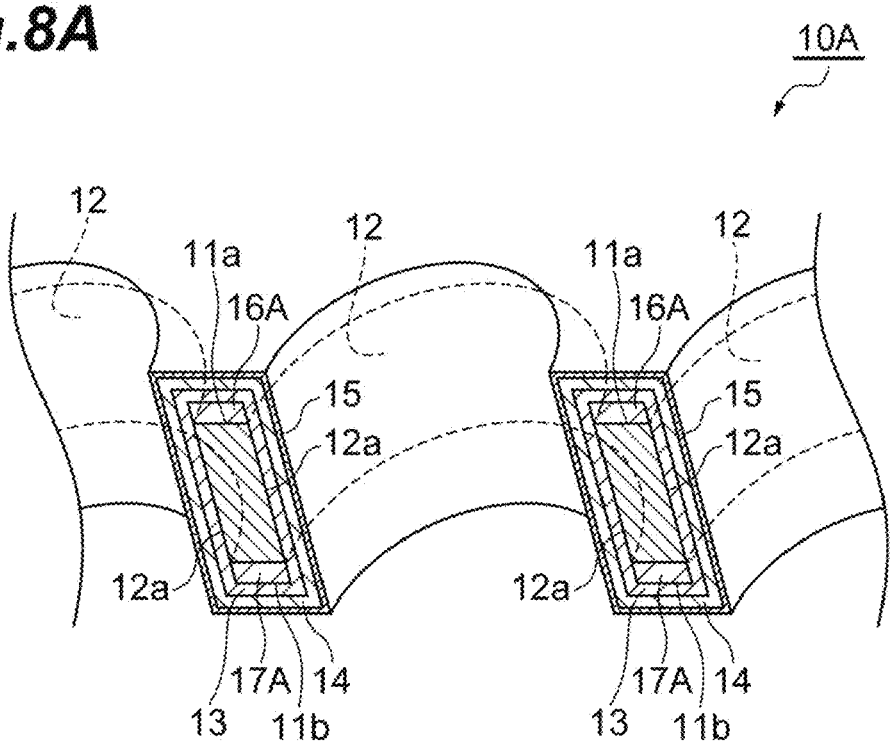
FIG. 8A is a cross-sectional view of a microchannel plate according to a variation.

Subsequently, the electron emission film 14 is formed at step S4, and then the protection film 15 is formed at step S5. Specifically, a cycle of depositing the $Al_2O_3$ layer using the atomic layer deposition is repeated D times (step S4). A cycle of depositing the $SiO_2$ layer using the atomic layer deposition is repeated X times (step S5). The input electrode 16 and the output electrode 17 are formed by evaporation and the like. Thereafter, for example, heat treatment and the like are performed to obtain the microchannel plate 10. Meanwhile, it is also possible to manufacture a microchannel plate 10A by forming the resistance film 13, the electron emission film 14, and the protection film 15 at steps S1 to S5 described above after forming an input electrode 16A and an output electrode 17A on the substrate 11 in advance by evaporation and the like (refer to FIG. 8A). In this case, the input electrode 16A is formed so as to be in contact with the input surface 11*a* of the substrate 11 and the output electrode 17A is formed so as to be in contact with the output surface 11*b*, and the resistance film 13, the electron emission film 14, and the protection film 15 are sequentially formed so as to cover the input electrode 16A and the output electrode 17A. A range in which the resistance film 13, the electron emission film 14, and the protection film 15 are formed is as described above, and the range is a range which covers the input surface 11*a*, the output surface 11*b*, the inner wall surface 12*a* of the channel 12, and the side surface 11*c* as described above.

Next, a characteristic of the microchannel plate 10 is described.

In the following description, as an example, the microchannel plate 10 manufactured by setting the number of times of deposition (X times) of the $SiO_2$ layer to 3, 5, 7, 10, 12, 15, 17, 20, and 25 in the method of manufacturing the microchannel plate 10 illustrated in FIG. 2 is prepared. Hereinafter, the microchannel plate 10 in which the protection film 15 is formed by depositing the $SiO_2$ layer five times on the electron emission film 14 formed by stacking $Al_2O_3$ 50 times is made an example 1. A microchannel plate in which no $SiO_2$ film is formed on the electron emission film made of $Al_2O_3$ (comparative example) is prepared.

Figure 4:
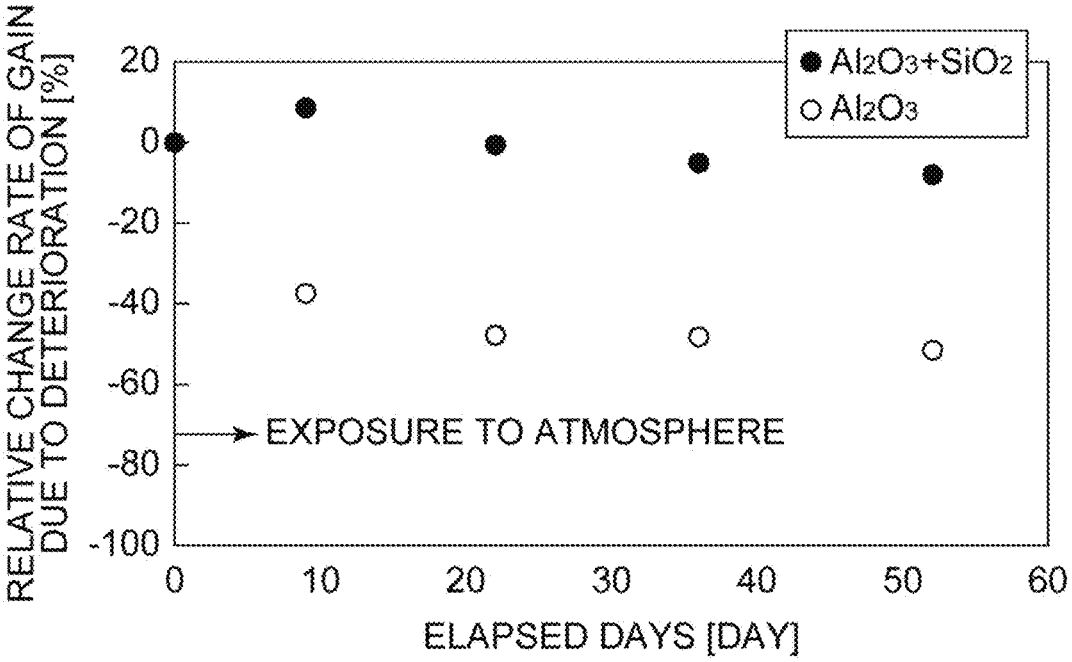
FIG. 4 is a view illustrating a relative change rate of a gain due to deterioration in a case where the microchannel plate is exposed to the atmosphere.

FIG. 4 is a view illustrating a relative change rate of the gain due to deterioration in a case where the microchannel plate is exposed to the atmosphere. The example of FIG. 4 illustrates a result of measuring change over time of the gain when the manufactured microchannel plate is stored in $N_2$ and then exposed to the atmosphere. The relative change rate of the gain due to the deterioration over time based on the gain of the microchannel plate immediately before the exposure to the atmosphere (0 day elapsed) is plotted along the ordinate in FIG. 4. In the example of FIG. 4, regarding the example 1 and the comparative example, points at which the microchannel plate is exposed for 0, 9, 22, 36 and 52 days are plotted. In the example of FIG. 4, the example 1 is indicated by black circle plots and the comparative example is indicated by hollow circle plots.

As illustrated in FIG. 4, it is understood that the gain decreases due to atmospheric release in the comparative example, but the decrease in gain is suppressed in the example 1 in the case where the microchannel plate is exposed to the atmosphere. Therefore, when comparing the example 1 with the comparative example, in the microchannel plate 10 in which the $SiO_2$ layer is deposited five times on the electron emission film 14 made of $Al_2O_3$ to form the protection film 15, the deterioration over time of the gain due to the exposure of the microchannel plate 10 to the atmosphere may be suppressed.

Figure 5:
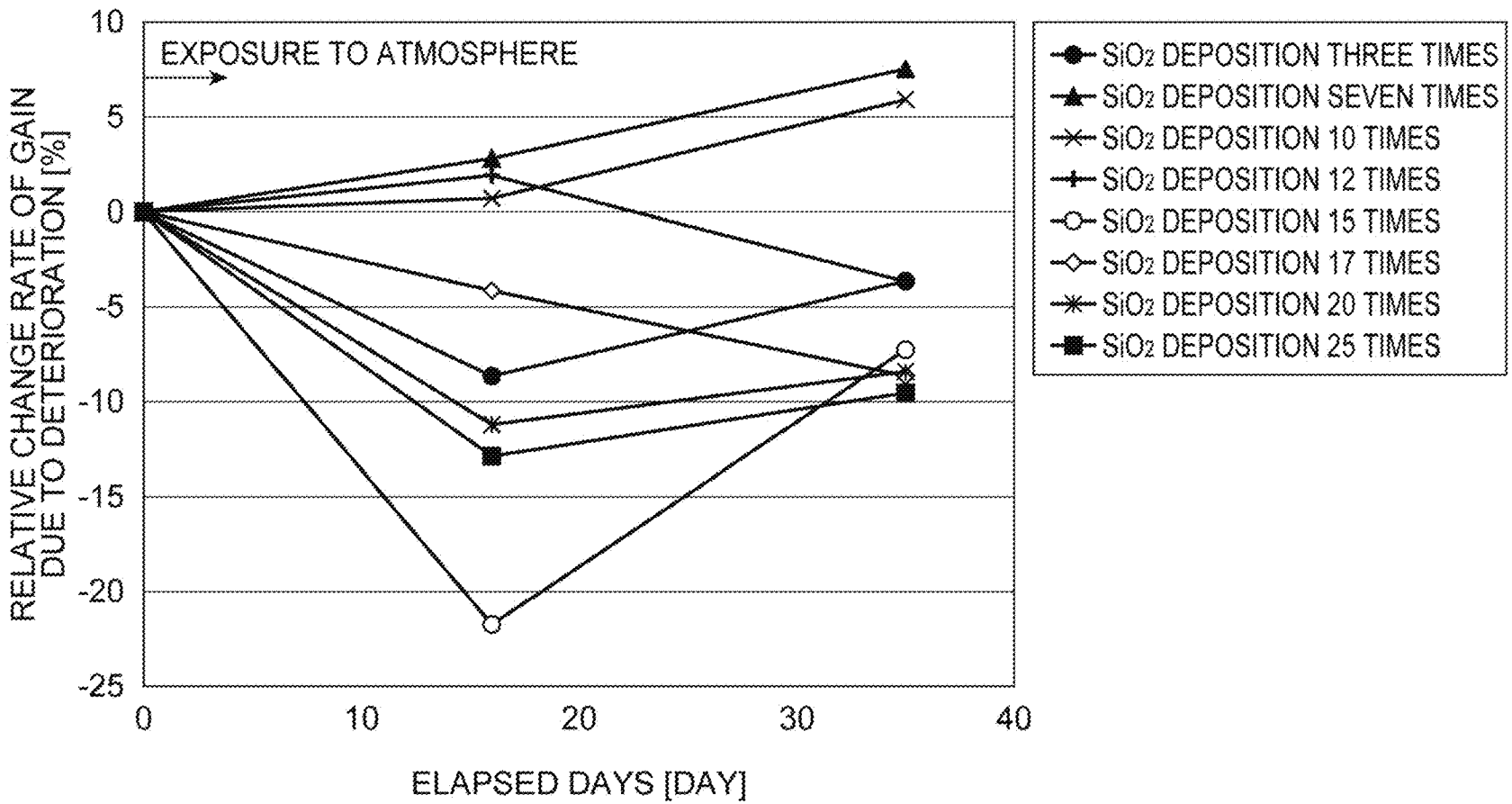
FIG. 5 is another view illustrating the relative change rate of the gain due to the deterioration in a case where the microchannel plate is exposed to the atmosphere.

FIG. 5 is another view illustrating the relative change rate of the gain due to the deterioration in the case where the microchannel plate is exposed to the atmosphere. In the example of FIG. 5, the manufactured microchannel plate is stored in $N_2$ during a period until the gain is stabilized, and then exposed to the atmosphere. The relative change rate of the gain due to the deterioration over time based on the gain of the microchannel plate 10 immediately before the exposure to the atmosphere (0 day elapsed) is plotted along the ordinate in FIG. 5. In the example of FIG. 5, regarding the microchannel plate 10 manufactured while setting the number of times of deposition of the $Al_2O_3$ layer to 30, and the number of times of deposition (X times) of the $SiO_2$ layer to 3, 7, 10, 12, 15, 17, 20, and 25, points at which the microchannel plate 10 is exposed for 0, 16, and 35 days are plotted.

As illustrated in FIG. 5, in the case where the microchannel plate 10 is exposed to the atmosphere, the relative change rate of the gain due to the deterioration based on the gain when the microchannel plate 10 is exposed for 0 day is basically within a certain range irrespective of the number of times of deposition of the $SiO_2$ layer (thickness of the protection film 15). Specifically, the relative change rate is not less than −25% at least in a range in which the microchannel plate 10 is exposed for 0 day to 35 days. This relative change rate is not less than −10% when the microchannel plate 10 is exposed for 35 days. That is, it was found that, in the microchannel plate 10, the deterioration over time of the gain due to the exposure of the microchannel plate 10 to the atmosphere may be suppressed irrespective of the number of times of deposition of the $SiO_2$ layer (thickness of the protection film 15).

Figure 6:
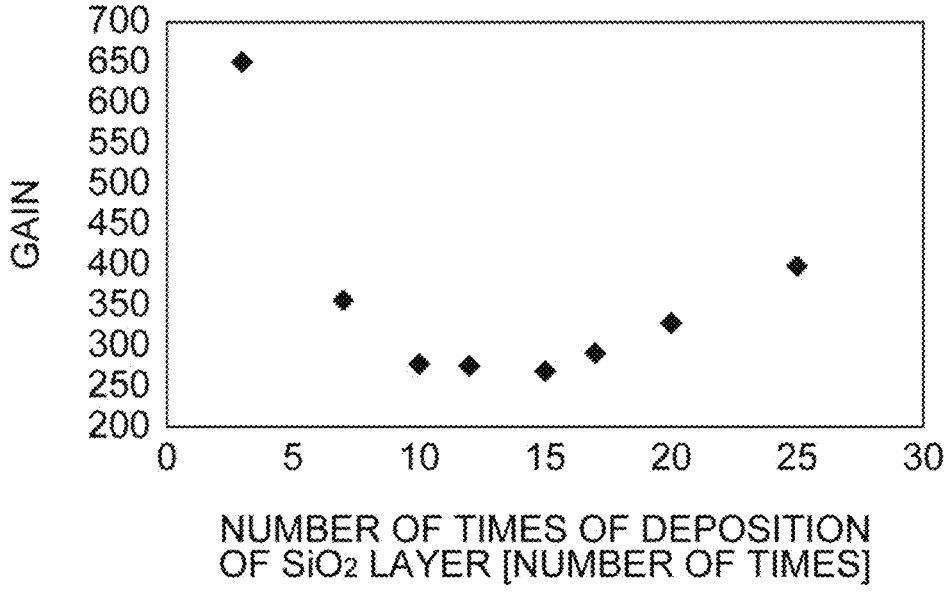
FIG. 6 is a view illustrating a relationship between the number of times of deposition of a $SiO_2$ layer in the microchannel plate of FIG. 1A and the gain.

FIG. 6 is a view illustrating a relationship between the number of times of deposition of the $SiO_2$ layer and the gain in the microchannel plate in FIG. 1A, which is a result of a case where the $Al_2O_3$ layer or other electron emission layer is not formed. The gain regarding the microchannel plate 10 manufactured while setting the number of times of deposition (X times) of the $SiO_2$ layer to 3, 5, 7, 10, 12, 15, 17, 20 and 25 is plotted along the ordinate in FIG. 6. As illustrated in FIG. 6, in the microchannel plate 10, in a case where the number of times of deposition of the $SiO_2$ layer is less than 10 (the thickness of the protection film 15 is less than approximately 10 angstroms), as the number of times of deposition of the $SiO_2$ layer increases (as the thickness of the protection film 15 increases), the gain demonstrates a decreasing tendency. In a case where the number of times of deposition of the $SiO_2$ layer is 10 or more and less than 15 (the thickness of the protection film 15 is approximately 10 angstroms or more and less than 15 angstroms), the gain is substantially constant irrespective of the number of times of deposition of the $SiO_2$ layer (the thickness of the protection film 15). In a case where the number of times of deposition of the $SiO_2$ layer is 15 or more (the thickness of the protection film 15 is approximately 15 angstroms or more), as the number of times of deposition of the $SiO_2$ layer increases (as the thickness of the protection film 15 increases), the gain demonstrates an increasing tendency.

The increasing tendency and the decreasing tendency of the gain are considered in consideration of magnitude of secondary electron emission coefficients of the electron emission film 14 and the protection film 15. Meanwhile, in the following description, the secondary electron emission coefficient is an index indicating a degree of emission of secondary electrons when focusing on the film itself. The gain is an index indicating the degree of emission of the secondary electrons in a state in which the film is formed on the channel.

Generally, the secondary electron emission coefficient of the electron emission film 14 made of $Al_2O_3$ tends to be larger than the secondary electron emission coefficient of the protection film 15 made of $SiO_2$. However, as the number of times of deposition of the $SiO_2$ layer formed on the electron emission film 14 increases (as the thickness the protection film 15 increases), the secondary electrons emitted from the electron emission film 14 are easily blocked by the protection film 15. Therefore, it is considered that, in a case where the thickness of the protection film 15 is less than approximately 10 angstroms, an effect that the secondary electrons emitted from the electron emission film 14 made of $Al_2O_3$ are blocked by the protection film 15 is more likely to appear as compared with a case where the thickness of the protection film 15 is approximately 10 angstroms or more, so that the decreasing tendency of the gain occurs.

The secondary electron emission coefficient of the protection film 15 increases as the number of times of deposition of the $SiO_2$ layer increases (as the thickness of the protection film 15 increases).

Therefore, it is considered that, in a case where the number of times of deposition of the $SiO_2$ layer is 10 or more and less than 15 (the thickness of the protection film 15 is approximately 10 angstroms or more and less than 15 angstroms), as compared with a case where the thickness of the protection film 15 is approximately 15 angstroms or more, the effect that the secondary electrons emitted from the electron emission film 14 made of $Al_2O_3$ are blocked by the protection film 15 and an effect of the increased secondary electron emission coefficient of the protection film 15 cancel each other, so that the gain becomes substantially constant irrespective of the number of times of deposition of the $SiO_2$ layer (the thickness of the protection film 15).

It is considered that, in the case where the thickness of the protection film 15 is approximately 15 angstroms or more, the effect of the increased secondary electron emission coefficient of the protection film 15 is more likely to appear as compared to the case where the thickness of the protection film 15 is less than approximately 15 angstroms, so that the increasing tendency of the gain occurs.

Therefore, in the microchannel plate 10, it is considered that the characteristic of $Al_2O_3$ having a large secondary electron emission coefficient may be utilized and the gain may be efficiently improved when the thickness of the protection film 15 is set to less than 15 angstroms and the first film made of $Al_2O_3$ is allowed to serve as a main secondary electron multiplier layer as compared to a case where the thickness of the protection film 15 is set to 15 angstroms or more to increase the secondary electron emission coefficient of the protection film 15. Therefore, in the microchannel plate 10, the thickness of the protection film 15 may be less than 15 angstroms. In the microchannel plate 10, the thickness of the protection film 15 may be less than 10 angstroms. In particular, in the microchannel plate 10, the thickness of the protection film 15 may be 3 angstroms to 5 angstroms.

Meanwhile, as described above, in the microchannel plate 10, contribution of the protection film 15 made of $SiO_2$ to the secondary electron multiplication is smaller than the contribution of the electron emission film 14 made of $Al_2O_3$ to the secondary electron multiplication. It may also be said that the protection film 15 serves as an electron non-emission film which does not substantially emit the secondary electrons.

[Action and Effect]

As described above, in the microchannel plate 10, since the protection film 15 made of $SiO_2$ is provided on the electron emission film 14 made of $Al_2O_3$, when the microchannel plate 10 is exposed to the atmosphere, for example, it is possible to suppress the deterioration over time of the gain. Since the electron emission film 14 made of $Al_2O_3$ is made thicker than the protection film 15 made of $SiO_2$, it is possible to allow the electron emission film 14 made of $Al_2O_3$ to serve as the main secondary electron multiplier layer while utilizing the characteristic of $Al_2O_3$ having the large secondary electron emission coefficient, thereby efficiently improving the gain. Therefore, it is possible to suppress the deterioration over time of the gain while improving the gain.

The thickness of the electron emission film 14 is 10 angstroms or more when being calculated using the X-ray fluorescence analysis. Since the electron emission film 14 made of $Al_2O_3$ has the thickness of 10 angstroms or more as described above, the electron emission film 14 may be allowed to effectively serve as the secondary electron multiplier layer.

The substrate 11 is made of an insulating material, and the resistance film 13 is formed between the inner wall surface 12*a* of the channel 12 and the electron emission film 14. As a result, when voltage is applied between the input electrode 16 provided on the input surface 11*a* of the substrate 11 and the output electrode 17 provided on the output surface 11*b* of the substrate 11, a potential gradient is formed by the resistance film 13, and electron multiplication becomes possible.

The electron emission film 14 and the protection film 15 are formed on the input surface 11*a*, the output surface 11*b*, and the side surface 11*c* of the substrate 11, and the input electrode 16 and the output electrode 17 are formed on the protection film 15. Alternatively, the input electrode 16A is formed so as to be in contact with the input surface 11*a* of the substrate 11 and the output electrode 17A is formed so as to be in contact with the output surface 11*b*, and the electron emission film 14 and the protection film 15 are formed on the input electrode 16A and the output electrode 17A, the input surface 11*a*, the output surface 11*b*, and the side surface 11*c* of the substrate 11. In these configurations, since the electron emission film 14 and the protection film 15 cover the input surface 11*a*, the output surface 11*b*, and the side surface 11*c* of the substrate 11, the gas emission from the substrate 11 may be effectively suppressed in a case where the substrate 11 is made of a material which emits a large amount of gas, for example.

The resistance film 13, the electron emission film 14, and the protection film 15 are formed on the input surface 11*a*, the output surface 11*b*, and the side surface 11*c* of the substrate 11, and the input electrode 16 and the output electrode 17 are formed on the protection film 15. Alternatively, the input electrode 16A is formed so as to be in contact with the input surface 11*a* of the substrate 11 and the output electrode 17A is formed so as to be in contact with the output surface 11*b*, and the resistance film 13, the electron emission film 14, and the protection film 15 are formed on the input surface 11*a*, the output surface 11*b*, and the side surface 11*c* of the substrate 11. In these configurations, since not only the electron emission film 14 and the protection film 15 but also the resistance film 13 cover the input surface 11*a*, the output surface 11*b*, and the side surface 11*c* of the substrate 11, the gas emission from the substrate 11 may be effectively suppressed in the case where the substrate 11 is made of the material which emits a large amount of gas, for example.

The electron emission film 14 and the protection film 15 are layers formed using the atomic layer deposition. As a result, since the electron emission film 14 and the protection film 15 may be formed at an atomic layer level, the film in which the defect such as the pinhole is suppressed with the uniform film quality may be formed. A mixed film containing a plurality of metal oxides (for example, $Al_2O_3$ and $SiO_2$) may be formed in the order of angstroms. For example, it is possible to form the film for the gap and the trench structure with the high aspect ratio such as the microchannel plate 10.

[Variation of Microchannel Plate 10]

Although a substrate 11 is made of an insulating material in the above-described embodiment, the substrate 11 may also be made of a semiconductor material (resistant material) such as Si. In this case, it is not necessary to provide a resistance film 13 on an inner wall surface 12*a* of a channel 12, and an electron emission film 14 may be formed directly on the substrate 11 (formed at least on the inner wall surface 12*a*). Even in such a mode, an action and an effect similar to those of the above-described embodiment may be obtained. Since a manufacturing process of the resistance film 13 may be omitted, a manufacturing cost may be reduced.

[Second Embodiment]

Figure 7:
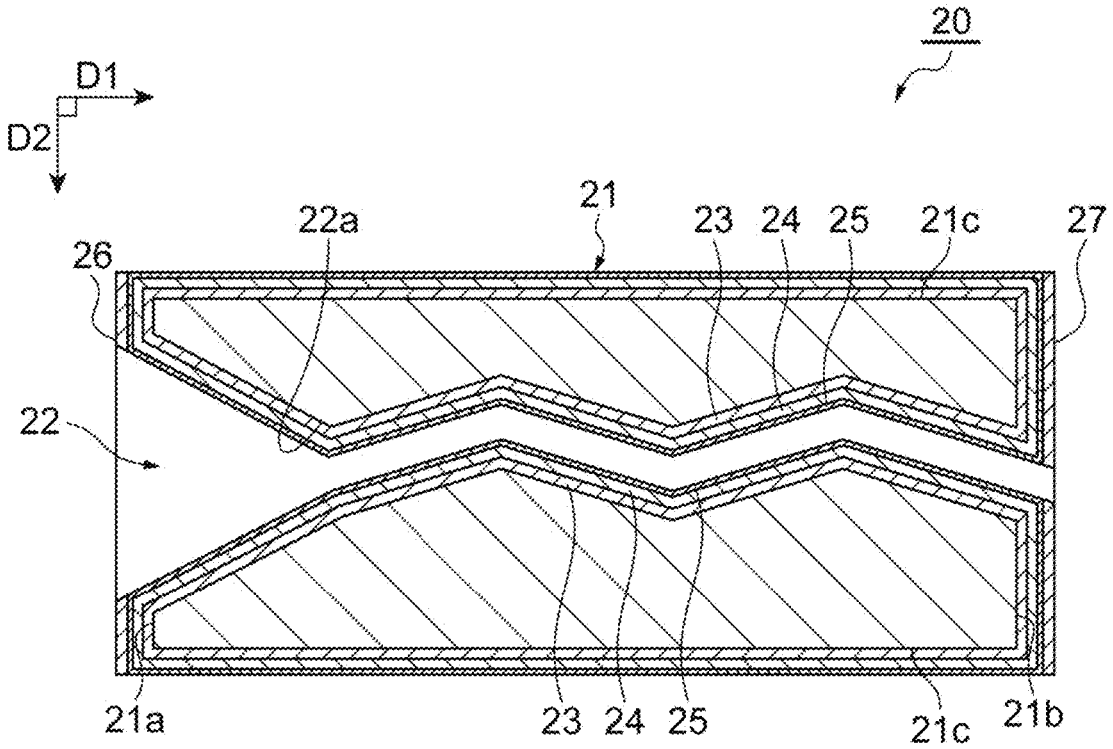
FIG. 7 is a cross-sectional view of an electron multiplier according to a second embodiment.

FIG. 7 is a cross-sectional view of an electron multiplier according to a second embodiment. As illustrated in FIG. 7, the electron multiplier 20 is a dynode structure functioning to multiply electrons. The electron multiplier 20 includes a main body 21 including one end face (front surface) 21*a* and the other end face (rear surface) 21*b*. The main body 21 has a rectangular parallelepiped shape and extends in a first direction D1. The main body 21 is made of an insulating material such as ceramic, for example. Meanwhile, the electron multiplier 20 is not limited to this example, and may also be a dynode structure such as a so-called single channel dynode (for example, a channeltron and the like).

A channel 22 is formed in the main body 21. The channel 22 opens on one end face 21*a* and the other end face 21*b* of the main body 21 in the first direction D1. That is, the channel 22 penetrates from the one end face 21*a* to the other end face 21*b* of the main body 21. One end face 21*a* side of the channel 22 has a tapered shape expanding toward the one end face 21*a*. The channel 22 extends in a wave shape such that bending in a second direction D2 is repeated from the one end face 21*a* to the other end face 21*b*. In the channel 22, electrons are incident on the one end face 21*a* side, secondary electrons are emitted according to the incident electrons, and the secondary electrons are emitted from the other end face 21*b* side.

A resistance film 23, an electron emission film (first film) 24, a protection film (second film) 25, an input electrode (electrode layer) 26, and an output electrode (electrode layer) 27 are formed on the main body 21 as functional films.

The resistance film 23 is provided on an inner wall surface 22*a* of the channel 22. The resistance film 23 is provided so as to cover an outer surface of the main body 21. Specifically, the resistance film 23 is formed at least on the inner wall surface 22*a* of the channel 22. The resistance film 23 is formed on the one end face 21*a* except for the opening of the channel 22. The resistance film 23 is formed on the other end face 21*b* except for the opening of the channel 22. The resistance film 23 is formed so as to cover a side surface 21*c* of the main body 21. Since the resistance film 23 covers the one end face 21*a*, the other end face 21*b*, the inner wall surface 22*a* of the channel 22, and the side surface 21*c* in the above-described manner, gas emission from the main body 21 may be effectively suppressed in a case where the main body 21 is made of a material such as lead glass which emits a large amount of gas during operation, for example. The resistance film 23 has a predetermined resistance value suitable for electron multiplication in the electron multiplier 20. The resistance film 23 is formed, for example, by using atomic layer deposition in a manner similar to that of the resistance film 13. The resistance film 23 is formed, for example, by repeating a cycle of depositing an $Al_2O_3$ layer and a cycle of depositing a $TiO_2$ layer by the atomic layer deposition a plurality of times, respectively. A thickness of the resistance film 23 is, for example, approximately 200 angstroms to 700 angstroms.

The electron emission film 24 is a first film provided on the inner wall surface 22*a* of the channel 22. The electron emission film 24 is provided so as to cover the resistance film 23. Specifically, the electron emission film 24 is formed so as to be in contact with the resistance film 23 on at least the inner wall surface 22*a* of the channel 22. The electron emission film 24 is formed so as to be in contact with the resistance film 23 on the one end face 21*a* except for the opening of the channel 22. The electron emission film 24 is formed so as to be in contact with the resistance film 23 on the other end face 21*b* except for the opening of the channel 22. The electron emission film 24 is formed so as to cover the side surface 21*c* of the main body 21. Since the electron emission film 24 covers the one end face 21*a*the other end face 21*b*, the inner wall surface 22*a* of the channel 22, and the side surface 21*c* in the above-described manner, the gas emission from the main body 21 may be effectively suppressed in the case where the main body 21 is made of the material such as lead glass which emits a large amount of gas during operation, for example. When electrons accelerated by an electric field (to be described later) in the channel 22 collide with the electron emission film 24, the electron emission film 24 emits secondary electrons accordingly and multiplies the electrons. The electron emission film 24 is made of $Al_2O_3$. The electron emission film 24 is formed, for example, by using the atomic layer deposition in a manner similar to that of the electron emission film 14. The electron emission film 24 is formed, for example, by repeating a cycle of depositing the $Al_2O_3$ layer by the atomic layer deposition a plurality of times. A thickness of the electron emission film 24 is 10 angstroms or more when being calculated by X-ray fluorescence analysis. The thickness of the electron emission film 24 may also be, for example, approximately 30 angstroms to 50 angstroms.

The protection film 25 is a second film provided on the electron emission film 24 (first film). The protection film 25 suppresses deterioration over time of a gain of the secondary electron emission in the electron multiplier 20 in a case where the electron multiplier 20 is exposed to the atmosphere, for example. The protection film 25 is provided so as to cover the electron emission film 24. Specifically, the protection film 25 is formed so as to be in contact with the electron emission film 24 at least on the inner wall surface 22*a* of the channel 22. The protection film 25 is formed so as to be in contact with the electron emission film 24 on the one end face 21*a* except for the opening of the channel 22. The protection film 25 is formed so as to be in contact with the electron emission film 24 on the other end face 21*b* except for the opening of the channel 22. The protection film 25 is formed so as to cover the side surface 21*c* of the main body 21. The protection film 25 is made of $SiO_2$. The protection film 25 is formed, for example, by using the atomic layer deposition in a manner similar to that of the protection film 15. The protection film 25 is formed, for example, by repeating a cycle of depositing the $SiO_2$ layer by the atomic layer deposition a plurality of times. A thickness of the protection film 25 is, for example, a half or less of that of the electron emission film 24. The thickness of the protection film 25 may also be, for example, approximately 3 angstroms to 15 angstroms. That is, the electron emission film 24 is thicker than the protection film 25.

The input electrode 26 and the output electrode 27 are provided on the one end face 21*a* and the other end face 21*b* of the main body 21, respectively. Specifically, the input electrode 26 is formed so as to be in contact with the protection film 25 on the one end face 21*a* except for the opening of the channel 22. The output electrode 27 is formed so as to be in contact with the protection film 25 on the other end face 21*b* except for the opening of the channel 22. The input electrode 26 and the output electrode 27 are formed by evaporating, for example, a metal film containing nickel-based metal and the like. By using evaporation, the input electrode 26 is formed on the one end face 21*a* except for the opening of the channel 22, and the output electrode 27 is formed on the other end face 21*b* except for the opening of the channel 22. Thicknesses of the input electrode 26 and the output electrode 27 are, for example, approximately 1000 angstroms.

Herein, in order to specify structures or characteristics of the resistance film 23, the electron emission film 24, and the protection film 25 (hereinafter referred to as "ALD film" in this paragraph) formed by the atomic layer deposition, it is necessary to analyze a surface state of the ALD film. However, the electron multiplier 20 also is a structure having a high aspect ratio similar to a microchannel plate 10, and no device capable of specifically analyzing the surface state of the ALD film formed on the electron multiplier 20 is currently known, so that it is difficult to analyze a laminated structure itself of the ALD film. As described above, it is technically impossible or impractical to analyze the structure or the characteristic of the ALD film at the time of filing, so that there is a circumstance that it is impossible or impractical to directly specify the ALD film by its structure or characteristic in the electron multiplier 20.

Figure 8B:
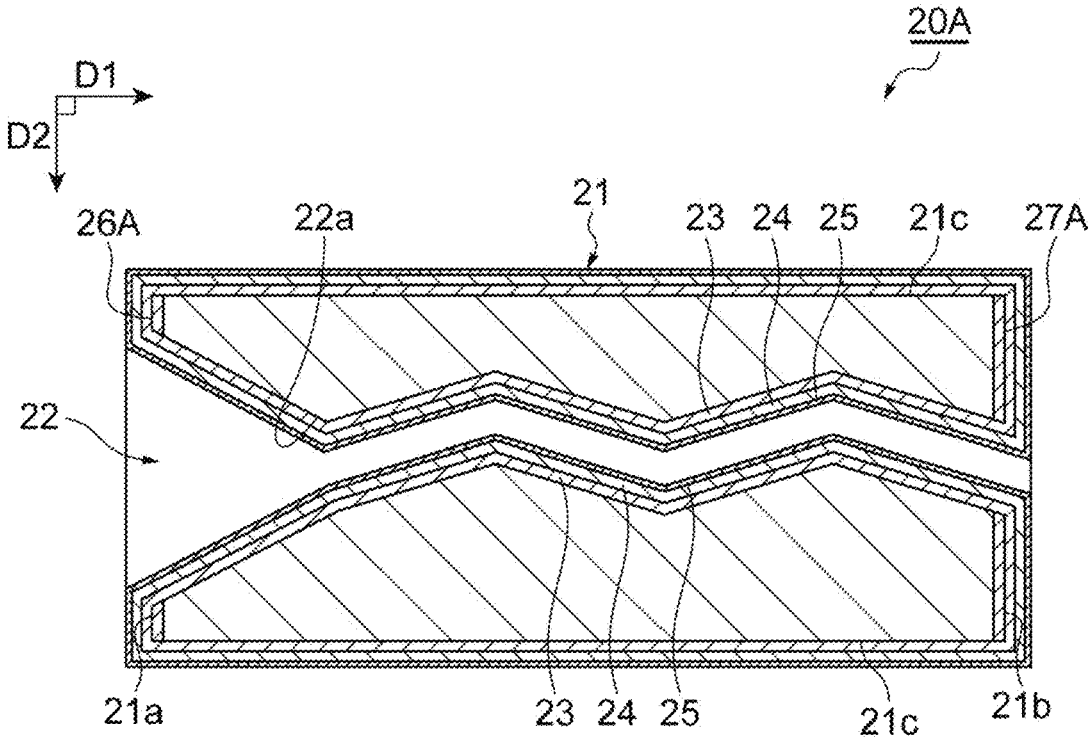
FIG. 8B is a cross-sectional view of an electron multiplier according to a variation.

Next, a method of manufacturing the electron multiplier 20 is described. As illustrated in FIG. 2, the method of manufacturing the electron multiplier 20 is such that the resistance film 23 is formed on the main body 21 at steps S1 to S3, the electron emission film 24 is formed on the resistance film 23 at step S4, and thereafter, the protection film 25 is formed on the electron emission film 24 at step S5. Since the specific description is similar to that of the method of manufacturing the microchannel plate 10 described above, the specific description is omitted. Meanwhile, it is also possible to manufacture an electron multiplier 20A by forming the resistance film 23, the electron emission film 24, and the protection film 25 at steps S1 to S5 described above after forming an input electrode 26A and an output electrode 27A on the main body 21 in advance by evaporation and the like (refer to FIG. 8B). In this case, the input electrode 26A is formed so as to be in contact with the one end face 21*a* of the main body 21 and the output electrode 27A is formed so as to be in contact with the other end face 21*b*, and the resistance film 23, the electron emission film 24, and the protection film 25 are sequentially formed so as to cover the input electrode 26A and the output electrode 27A. A range in which the resistance film 23, the electron emission film 24, and the protection film 25 are formed is as described above, and the range is a range which covers the one end face 21*a*, the other end face 21*b*, the inner wall surface 22*a*, and the side surface 21*c* as described above.

[Action and Effect]

The electron multiplier 20 configured in the above-described manner exhibits an action and an effect similar to those of the microchannel plate 10. That is, since the protection film 25 made of $SiO_2$ is provided on the electron emission film 24 made of $Al_2O_3$, the deterioration over time of the gain may be suppressed when the electron multiplier 20 is exposed to the atmosphere, for example. Since the electron emission film 24 made of $Al_2O_3$ is made thicker than the protection film 25 made of $SiO_2$, it is possible to allow the electron emission film 24 made of $Al_2O_3$ to serve as a main secondary electron multiplier layer while utilizing a characteristic of $Al_2O_3$ having a large secondary electron emission coefficient, thereby efficiently improving the gain. Therefore, it is possible to suppress the deterioration over time of the gain while improving the gain.

A thickness of the electron emission film 24 is 10 angstroms or more when being calculated by X-ray fluorescence analysis. Since the electron emission film 24 made of $Al_2O_3$ has the thickness of 10 angstroms or more as described above, the electron emission film 24 may be allowed to effectively serve as the secondary electron multiplier layer.

The main body 21 is made of an insulating material, and the resistance film 23 is formed between the main body 21 (inner wall surface 22*a* of the channel 22) and the electron emission film 24. As a result, when voltage is applied between the input electrode 26 provided on the one end face 21*a* of the main body 21 and the output electrode 27 provided on the other end face 21*b* of the main body 21, a potential gradient is formed by the resistance film 23, and electron multiplication becomes possible.

The electron emission film 24 and the protection film 25 are formed on the one end face 21*a*, the other end face 21*b*, and the side surface 21*c* of the main body 21, and the input electrode 26 and the output electrode 27 are formed on the protection film 25. Alternatively, the input electrode 26A is formed so as to be in contact with the one end face 21*a* of the main body 21 and the output electrode 27A is formed so as to be in contact with the other end face 21*b*, and the electron emission film 24 and the protection film 25 are formed on the input electrode 26A and the output electrode 27A, and the one end face 21*a*, the other end face 21*b*, and the side surface 21*c* of the main body 21. In these configurations, since the electron emission film 24 and the protection film 25 cover the one end face 21*a*, the other end face 21*b*, and the side surface 21*c* of the main body 21, the gas emission from the main body 21 may be effectively suppressed in a case where the main body 21 is made of a material which emits a large amount of gas, for example.

The resistance film 23, the electron emission film 24, and the protection film 25 are formed on the one end face 21*a*, the other end face 21*b*, and the side surface 21*c* of the main body 21, and the input electrode 26 and the output electrode 27 are formed on the protection film 25. Alternatively, the input electrode 26A is formed so as to be in contact with the one end face 21*a* of the main body 21 and the output electrode 27A is formed so as to be in contact with the other end face 21*b*, and the resistance film 23, the electron emission film 24, and the protection film 25 are formed on the one end face 21*a*, the other end face 21*b*, and the side surface 21*c* of the main body 21. In these configurations, since not only the electron emission film 24 and the protection film 25 but also the resistance film 23 cover the one end face 21*a*, the other end face 21*b*, and the side surface 21*c* of the main body 21, the gas emission from the main body 21 may be effectively suppressed in the case where the main body 21 is made of the material which emits a large amount of gas, for example.

The electron emission film 24 and the protection film 25 are layers formed by the atomic layer deposition. As a result, since the electron emission film 24 and the protection film 25 may be formed at an atomic layer level, the film in which a defect such as a pinhole is suppressed with a uniform film quality may be formed. A mixed film containing a plurality of metal oxides (for example, $Al_2O_3$ and $SiO_2$) may be formed in the order of angstroms. For example, it is possible to form a film for a gap and a trench structure with a high aspect ratio such as the electron multiplier 20.

[Variation of Electron Multiplier 20]

Although a main body 21 is made of an insulating material in the above-described embodiment, the main body 21 may also be made of a semiconductor material (resistant material) such as Si. In this case, it is not necessary to provide a resistance film 23 on the main body 21, and an electron emission film 24 may also be formed directly on the main body 21 (formed at least on an inner wall surface 22*a*). Even in such a mode, an action and an effect similar to those of the above-described embodiment may be obtained. Since a manufacturing process of the resistance film 23 may be omitted, a manufacturing cost may be reduced.

INDUSTRIAL APPLICABILITY

According to one aspect of the present invention, it is possible to provide a microchannel plate and an electron multiplier capable of suppressing deterioration over time of a gain while improving the gain.

REFERENCE SIGNS LIST

10 Microchannel plate
11*a* Input surface (front surface)
11*b* Output side (rear surface)
11 Substrate
12 Channel
12*a* Inner wall surface
13 Resistance film
14 Electron emission film (first film)
15 Protection film (second film)
16 Input electrode (electrode layer)
17 Output electrode (electrode layer)
20 Electron multiplier

21 Main body
21*a* One end face (front face)
21*b* Other end face (rear face)
22 Channel
22*a* Inner wall surface
23 Resistance film
24 Electron emission film (first film)
25 Protection film (second film)
26 Input electrode (electrode layer)
27 Output electrode (electrode layer)

The invention claimed is:

1. A microchannel plate comprising:
a substrate including a front surface, a rear surface, and a side surface;
a plurality of channels penetrating from the front surface to the rear surface of the substrate;
a first film provided on at least an inner wall surface of the channel;
a second film provided on the first film; and
electrode layers provided on the front surface and the rear surface of the substrate,
wherein the first film is made of $Al_2O_3$,
the second film is made of $SiO_2$, and
the first film is thicker than the second film.

2. The microchannel plate according to claim 1, wherein a thickness of the first film is 10 angstroms or more when being calculated using X-ray fluorescence analysis.

3. The microchannel plate according to claim 1,
wherein the substrate is made of an insulating material, and
a resistance film is formed between the inner wall surface of the channel and the first film.

4. The microchannel plate according to claim 1, wherein the substrate is made of a resistant material.

5. The microchannel plate according to claim 1,
wherein the first film and the second film are formed on the front surface, the rear surface, and the side surface of the substrate, and
the electrode layers are formed on the second film.

6. The microchannel plate according to claim 1,
wherein the electrode layers are formed so as to be in contact with the front surface and the rear surface of the substrate, and
the first film and the second film are formed on the electrode layers, and the front surface, the rear surface, and the side surface of the substrate.

7. The microchannel plate according to claim 3,
wherein the resistance film, the first film, and the second film are formed on the front surface, the rear surface, and the side surface of the substrate, and
the electrode layers are formed on the second film.

8. The microchannel plate according to claim 3,
wherein the electrode layers are formed so as to be in contact with the front surface and the rear surface of the substrate, and
the resistance film, the first film, and the second film are formed on the front surface, the rear surface, and the side surface of the substrate.

9. The microchannel plate according to claim 1,
wherein the first film and the second film are layers formed by atomic layer deposition.

10. The microchannel plate according to claim 1, wherein the second film is an outermost film.

11. An electron multiplier comprising:
a main body including a front surface, a rear surface, and a side surface;
a channel penetrating from the front surface to the rear surface of the main body;
a first film provided on at least an inner wall surface of the channel;
a second film provided on the first film; and
electrode layers provided on the front surface and the rear surface of the main body,
wherein the first film is made of $Al_2O_3$,
the second film is made of $SiO_2$, and
the first film is thicker than the second film.

12. The electron multiplier according to claim 11, wherein a thickness of the first film is 10 angstroms or more when being calculated using X-ray fluorescence analysis.

13. The electron multiplier according to claim 11,
wherein the main body is made of an insulating material, and
a resistance film is formed between the inner wall surface of the channel and the first film.

14. The electron multiplier according to claim 11, wherein the main body is made of a resistant material.

15. The electron multiplier according to claim 11,
wherein the first film and the second film are formed on the front surface, the rear surface, and the side surface of the main body, and
the electrode layers are formed on the second film.

16. The electron multiplier according to claim 11,
wherein the electrode layers are formed so as to be in contact with the front surface and the rear surface of the main body, and
the first film and the second film are formed on the electrode layers, and the front surface, the rear surface, and the side surface of the main body.

17. The electron multiplier according to claim 13,
wherein the resistance film, the first film, and the second film are formed on the front surface, the rear surface, and the side surface of the main body, and
the electrode layers are formed on the second film.

18. The electron multiplier according to claim 13,
wherein the electrode layers are formed so as to be in contact with the front surface and the rear surface of the main body, and
the resistance film, the first film, and the second film are formed on the front surface, the rear surface, and the side surface of the main body.

19. The electron multiplier according to claim 11, wherein the first film and the second film are layers formed by atomic layer deposition.

20. The electron multiplier according to claim 11, wherein the second film is an outermost film.

* * * * *